US009460704B2

(12) United States Patent
Senior et al.

(10) Patent No.: US 9,460,704 B2
(45) Date of Patent: Oct. 4, 2016

(54) DEEP NETWORKS FOR UNIT SELECTION SPEECH SYNTHESIS

(71) Applicant: Google Inc., Mountain View, CA (US)

(72) Inventors: Andrew W. Senior, New York, NY (US); Javier Gonzalvo Fructuoso, London (GB)

(73) Assignee: Google Inc., Mountain View, CA (US)

( * ) Notice: Subject to any disclaimer, the term of this patent is extended or adjusted under 35 U.S.C. 154(b) by 340 days.

(21) Appl. No.: 14/019,967

(22) Filed: Sep. 6, 2013

(65) Prior Publication Data

US 2015/0073804 A1 Mar. 12, 2015

(51) Int. Cl.

| | |
|---|---|
| ***G10L 13/00*** | (2006.01) |
| ***G10L 13/06*** | (2013.01) |
| *G10L 25/30* | (2013.01) |

(52) U.S. Cl.

CPC ..... *G10L 13/06* (2013.01); *G10L 25/30* (2013.01)

(58) Field of Classification Search

USPC ..... 704/235, 258–260

See application file for complete search history.

(56) References Cited

U.S. PATENT DOCUMENTS

| | | | | |
|---|---|---|---|---|
| 5,668,926 | A * | 9/1997 | Karaali et al. | 704/232 |
| 6,134,528 | A * | 10/2000 | Miller et al. | 704/258 |
| 6,366,883 | B1 * | 4/2002 | Campbell et al. | 704/260 |
| 2012/0262096 | A1 * | 10/2012 | Lee et al. | 318/139 |

OTHER PUBLICATIONS

Hunt, Andrew J. et al., "Unit Selection in a Concatenative Speech Synthesis System Using a Large Speech Database," Proceedings of ICASSP 1996, vol. 1, pp. 373-376, Atlanta, Georgia, 4 pages.

* cited by examiner

*Primary Examiner* — Leonard Saint Cyr
(74) *Attorney, Agent, or Firm* — Fish & Richardson P.C.

(57) ABSTRACT

Methods, systems, and apparatus, including computer programs encoded on a computer storage medium, for providing a representation based on structured data in resources. The methods, systems, and apparatus include actions of receiving target acoustic features output from a neural network that has been trained to predict acoustic features given linguistic features. Additional actions include determining a distance between the target acoustic features and acoustic features of a stored acoustic sample. Further actions include selecting the acoustic sample to be used in speech synthesis based at least on the determined distance and synthesizing speech based on the selected acoustic sample.

17 Claims, 4 Drawing Sheets

DEEP NETWORKS FOR UNIT SELECTION SPEECH SYNTHESIS

TECHNICAL FIELD

This disclosure generally relates to speech synthesis.

BACKGROUND

Speech synthesis systems can be used to produce artificial human speech. For example, speech synthesis systems may receive text and output sounds that approximate a human speaking the text. The production of artificial human speech may be useful in circumstances where it is difficult for people to read text.

SUMMARY

In general, an aspect of the subject matter described in this specification may involve a process for synthesizing speech using a speech synthesis system. The system may receive text and output synthesized speech corresponding to the text. For example, the system may receive the text "seat" and output a sound approximating a human speaking "seat," which may sound like "see" followed closely by "eat."

To output synthesized text, the system may determine the phones that correspond to the text. For example, for the word "seat," the system may determine a phonetic representation of the word is "/ux/ /se/ /et/ /ux/," where the phone "/ux/" may represent silence. For the phones in the determined phonetic representation, the system may use a neural network to determine stored acoustic samples that are an appropriate match to the phones. For example, the system may determine that a stored acoustic sample of a person speaking "see" followed by a stored acoustic sample of a person speaking "eat" are an appropriate match to the phones.

To determine the stored acoustic samples that are an appropriate match to the phones, the system may determine linguistic features that describe each phone. For example, for the phone "/se/" the system may determine the linguistic features "/se/+/et/−/ux/," which may describe that the phone "/se/" precedes the phone "/et/" and follows the phone "/ux/."

The system may provide the determined linguistic features to the neural network for the neural network to output target acoustic features. The target acoustic features may be an estimate from the neural network of the acoustic features of an acoustic sample that would sound close to the phone described by the linguistic features.

The acoustic features may be a vector of elements that together represent a sound waveform. For example, the neural network may output target acoustic features that are a vector of elements that represent a waveform that sounds like "see" in response to input of linguistic features "/se/+/et/−/ux/" describing the phone "/se/" from the text "seat."

The system may determine candidate acoustic samples based on the target acoustic features output from the neural network and the acoustic features of stored acoustic samples. The candidate acoustic samples may be the acoustic samples that may be selected from to synthesize speech by joining the selected acoustic samples together. The system may determine candidate acoustic samples by identifying acoustic samples with acoustic features that are similar to the target acoustic features.

For each phone, the system may identify acoustic samples with acoustic features that are similar to the target acoustic features by determining a distance between the acoustic features of the acoustic samples and the target acoustic features. The system may determine the acoustic samples that have determined distances less than a maximum threshold distance are candidate acoustic samples.

The system may select one candidate acoustic sample as an appropriate match for each phone and concatenate the selected candidate acoustic samples to synthesis speech. In selecting the candidate acoustic samples for the phones, the system may select candidate acoustic samples with acoustic features that are similar to the target acoustic features, e.g., have a short distance to the target acoustic features, and that can be smoothly concatenated together.

In some aspects, the subject matter described in this specification may be embodied in methods that may include the actions of receiving target acoustic features output from a neural network that has been trained to predict acoustic features given linguistic features. Additional actions include determining a distance between the target acoustic features and acoustic features of a stored acoustic sample. Further actions include selecting the acoustic sample to be used in speech synthesis based at least on the determined distance and synthesizing speech based on the selected acoustic sample.

Other versions include corresponding systems, apparatus, and computer programs, configured to perform the actions of the methods, encoded on computer storage devices.

These and other versions may each optionally include one or more of the following features. For instance, in some implementations including providing the synthesized speech for output.

In additional aspects the target acoustic features include a plurality of values describing acoustic characteristics.

In some implementations determining a distance between the target acoustic features and acoustic features of a stored acoustic sample includes calculating an Euclidean distance between a point represented by the values of the target acoustic features and a point represented by values describing the acoustic features of the stored acoustic sample.

In certain aspects selecting the acoustic sample to be used in speech synthesis is further based on at least a join cost of the acoustic sample representing discontinuity of the acoustic sample and another acoustic sample consecutive with the acoustic sample.

In additional aspects, selecting the acoustic sample to be used in speech synthesis based on at least the determined distance includes determining the acoustic sample corresponds to a cost, based on (i) the determined distance and (ii) the join cost, that is less than or equal to costs based on (i) determined distances between the target acoustic features and acoustic features of other stored acoustic samples and (ii) join costs of the other stored acoustic samples.

In some implementations actions include determining a distance between the target acoustic features and a model that includes the stored acoustic samples and other acoustic samples and and selecting, based on at least the determined distance, the model to select acoustic samples within the model.

The details of one or more implementations of the subject matter described in this specification are set forth in the accompanying drawings and the description below. Other potential features, aspects, and advantages of the subject matter will become apparent from the description, the drawings, and the claims.

DESCRIPTION OF DRAWINGS

Like reference symbols in the various drawings indicate like elements.

DETAILED DESCRIPTION

Figure 1:
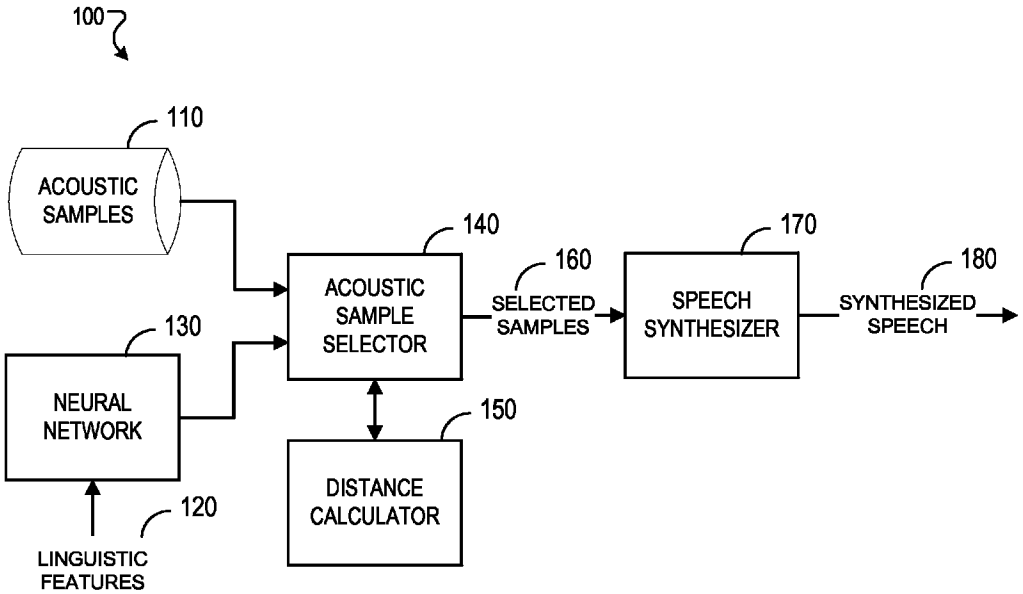
FIG. 1 is a block diagram of an example system for synthesizing speech.

In general, an aspect of the subject matter described in this specification may involve a process for synthesizing speech using a speech synthesis system. The system may receive text and output synthesized speech corresponding to the text. For example, the system may receive the text "cat" and output a sound approximating a human speaking "cat," which may sound like "ka" followed closely by "at."

To output synthesized text, the system may determine the phones that correspond to the text. For example, for the word "cat," the system may determine a phonetic representation of the word is "/ux/ /k/ /a/ /t/ /ux/," where the phone "/ux/" may represent silence. For the phones in the determined phonetic representation, the system may use a neural network to determine stored acoustic samples that are an appropriate match to the phones. For example, the system may determine that a stored acoustic sample of a person speaking "k" followed by stored acoustic samples for a person speaking "a" and "t" are an appropriate match to the phones.

To determine the stored acoustic samples that are an appropriate match to the phones, the system may determine linguistic features that describe each phone. For example, for the phone "/k/" the system may determine the linguistic features "/k/+/a/−/ux/," which may describe that the phone "/k/" precedes the phone "/a/" and follows the phone "/ux/."

The system may provide the determined linguistic features to the neural network for the neural network to output target acoustic features. The target acoustic features may be an estimate from the neural network of the acoustic features of an acoustic sample that would sound close to the phone described by the linguistic features.

The acoustic features may be a vector of elements that together represent a sound waveform. For example, the neural network may output target acoustic features that sound like "ka" in response to input of linguistic features "/k/+/a/−/ux/" for the phone "/k/" of the text "cat."

The system may determine candidate acoustic samples based on the target acoustic features output from the neural network and the acoustic features of stored acoustic samples. The candidate acoustic samples may be the acoustic samples that may be selected from to synthesize speech by joining the selected acoustic samples together. The system may determine candidate acoustic samples by identifying acoustic samples with acoustic features that are similar to the target acoustic features.

For each phone, the system may identify acoustic samples with acoustic features that are similar to the target acoustic features by determining a distance between the acoustic features of the acoustic samples and the target acoustic features. The system may determine the acoustic samples that have determined distances less than a maximum threshold distance are candidate acoustic samples.

The system may select one candidate acoustic sample as an appropriate match for each phone and concatenate the selected candidate acoustic samples to synthesis speech. In selecting the candidate acoustic samples for the phones, the system may select candidate acoustic samples with acoustic features that are similar to the target acoustic features, e.g., have a short distance to the target acoustic features, and that can be smoothly concatenated together.

FIG. 1 is a block diagram of an example system 100 for synthesizing speech. Generally, the system 100 may include an acoustic sample database 110 that stores acoustic samples, a neural network 130 that receives linguistic features 120 and outputs target acoustic features, an acoustic sample selector 140 that selects acoustic samples from the acoustic sample database 110 based on a distance between acoustic features of the acoustic samples and the target acoustic features, a distance calculator 150 that calculates the distance between acoustic features of the acoustic samples and the target acoustic features, and a speech synthesizer 170 that synthesizes speech 180 based on the selected acoustic samples 160.

The acoustic sample database 110 may include acoustic samples that are stored in association with acoustic features. The acoustic samples may represent short sound samples for phones in various different contexts. For example, the acoustic sample database 110 may include an acoustic sample that is a recording of a human pronouncing the phone "/k/" in the text "kit" and another acoustic sample of a human pronouncing the phone "/k/" in the text "like." The phone "/k/" preceded by silence and followed by the phone "/i/" may sound slightly different from the phone "/k/" preceded by the phone "/i/" and followed by the phone "/e/."

The acoustic samples may be stored in association with acoustic features that describe how the acoustic samples sound. For example, the acoustic features of an acoustic sample may be a vector of elements that represent a sound waveform that corresponds to the acoustic sample. The elements may represent different sound frequency ranges and the value of the elements may represent the magnitude of sound within the sound frequency range. Additionally or alternatively, the elements may represent fundamental frequencies of the acoustic sample.

The neural network 130 may receive linguistic features 120 and output target acoustic features based on the linguistic features 120. As described above, the linguistic features 120 may include phones and the contexts of the phones. For example, the linguistic features 120 for the phone "/a/" in the text "cat" may be "/a/+/t/−/k/."

The neural network 130 may receive a set of linguistic features for each phone. For example, to synthesize speech for the text "cat," the neural network 130 may also receive linguistic features for the phones "/k/" and "/t/." The set of linguistic features for the phone "/t/" may be "/t/+/ux/−/a/." The set of linguistic features for the phone "/k/" may be "/k/+/a/−/ux/."

The acoustic sample selector 140 may receive acoustic samples from the acoustic sample database 110 and receive target acoustic features from the neural network 130. Using the target acoustic features, the acoustic sample selector 140 may select acoustic samples to be used in speech synthesis. The acoustic sample selector 140 may select acoustic samples based on distances between the target acoustic features and the acoustic features of the acoustic samples. Shorter distances may correspond to closer matches between the sound of the acoustic sample and the sound of the target acoustic features output by the neural network 130.

The acoustic sample selector 140 may select acoustic samples based on reducing the distances between the target acoustic features and the acoustic features of the acoustic samples while also reducing discontinuity between continuous acoustic samples. For example, the acoustic sample selector 140 may select acoustic samples that minimize the distances between the target acoustic features and the acoustic features of the acoustic samples while also minimizing discontinuity between continuous acoustic samples. Discontinuity may result from selecting a first and second acoustic sample to be concatenated where the ending of the first acoustic sample is different from the beginning of the second acoustic sample.

The acoustic sample selector 140 may select acoustic samples by reducing a cost function that is based on a sample cost corresponding to the distances between the target acoustic features and the acoustic features of the acoustic samples and a join cost corresponding to an amount of discontinuity between the acoustic samples. For example, the acoustic sample selector 140 may select acoustic samples that minimize a cost function that is based on a sample cost corresponding to the distances between the target acoustic features and the acoustic features of the acoustic samples and a join cost corresponding to an amount of discontinuity between the acoustic samples. Accordingly, the acoustic sample selector 140 may select acoustic samples by balancing increasing accuracy in matching phones to acoustic samples and increasing smoothness between the selected acoustic samples.

The acoustic sample selector 140 may select acoustic samples by first generating, for each phone, a list of candidate acoustic samples for each phone from the acoustic samples stored in the acoustic sample database 110. The acoustic sample selector 140 may generate the list of candidate acoustic samples for each phone by including acoustic samples with acoustic features that are within a predetermined distance from the target acoustic features. For example, the acoustic sample selector 140 may generate a list of acoustic samples with acoustic features less than a distance of ten from the target acoustic features output by the neural network 130 in response to receiving a particular linguistic feature 120.

Once the acoustic sample selector 140 generates a list of candidate acoustic samples for each phone, the acoustic sample selector 140 may determine which candidate acoustic sample to select from each list to combine the selected candidate acoustic samples into synthesized speech. The acoustic sample selector 140 may determine the candidate acoustic samples that reduce a cost function based on the sample cost of the candidate acoustic samples, e.g., the distance, and the join cost of the candidate acoustic samples and select the determined candidate acoustic samples. For example, the acoustic sample selector 140 may determine the candidate acoustic samples that minimize a cost function based on the sample cost of the candidate acoustic samples. In some implementations, the acoustic sample selector 140 may perform a Viterbi search across sample costs and join costs to find the optimal sequence of acoustic samples from the candidate acoustic samples that minimizes the cost function.

Alternatively, the acoustic sample selector 140 may select the candidate acoustic samples that reduce the cost function to an appropriate amount. For example, the acoustic sample selector 140 may select candidate acoustic samples that reduce the cost function below a maximum threshold cost even if the selected candidate acoustic samples reduce the cost function to the third lowest amount.

The distance calculator 150 may calculate the distance between the target acoustic features and the acoustic features of the acoustic samples. The distance calculator 150 may receive target acoustic features and acoustic features of stored acoustic samples, and for each stored acoustic sample, calculate a Euclidean distance between a point represented by the values of the target acoustic features and a point represented by values describing the acoustic features of the stored acoustic sample. For example, if the acoustic features are vectors of forty elements, the distance calculator 150 may calculate the distance between the target acoustic features and acoustic features of a particular acoustic sample by determining the square root of the summation of the square of the differences of the values between corresponding elements in the vectors.

The speech synthesizer 170 may synthesize speech using the selected samples 160 selected by the acoustic sample selector 140. In synthesizing speech, the speech synthesizer 170 may concatenate the selected speech samples. For example, the speech synthesizer 170 may receive acoustic samples for the phones "/k/", "/a/", "/t/" in that order from the text "cat," and synthesize speech by concatenating the received acoustic samples in that order.

Different configurations of the system 100 may be used where functionality of the acoustic sample database 110, neural network 130, acoustic sample selector 140, distance calculator 150, and speech synthesizer 170 may be combined, further distributed, or interchanged. The system 100 may be implemented in a single device or distributed across multiple devices.

Figure 2:
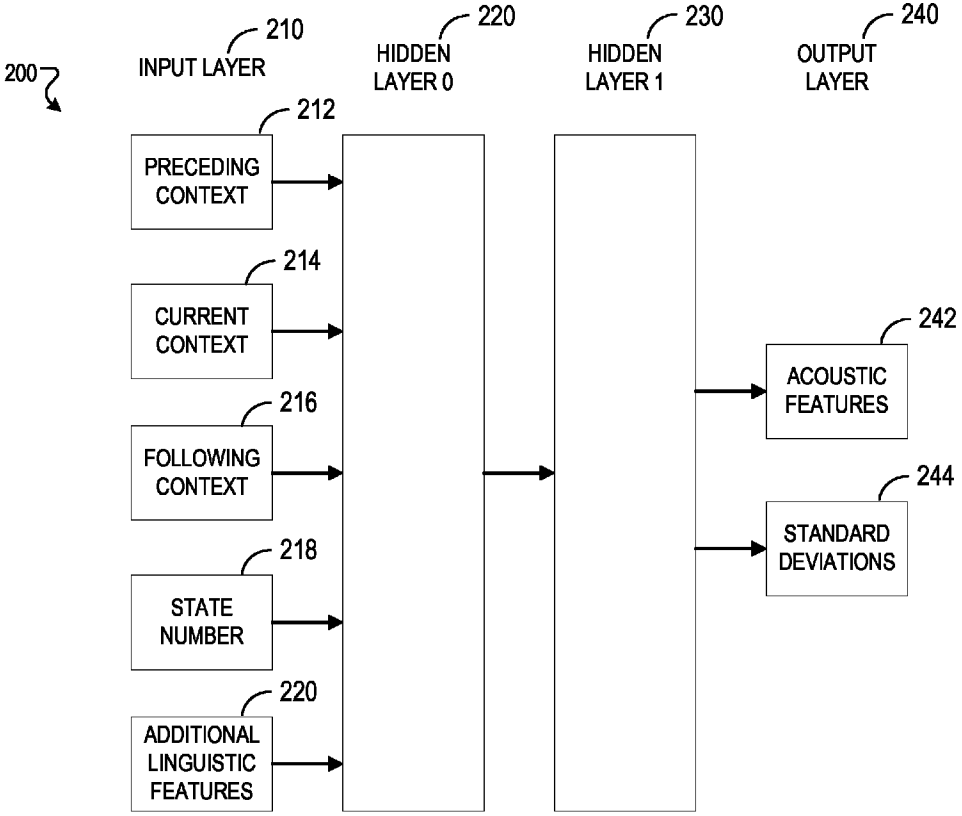
FIG. 2 is a block diagram of an example neural network for outputting target acoustic features.

FIG. 2 is a block diagram of an example neural network 200 for outputting target acoustic features. Neural network 200 may be an example of neural network 130 in FIG. 1. Neural network 200 includes an input layer 210 that receives inputs, one or more hidden layers 220, 230 that process the inputs, and an output layer 240 that outputs based on the hidden layers' 220, 230 processing of the inputs.

The input layer 210 receives linguistic features as inputs. The inputs for linguistic features include preceding context 212, current context 214, following context 216, state number 218, and additional linguistic features 220. For a particular phone, the preceding context may be the phone that occurs before the particular phone, the current context may be the particular phone, and the following context may be the following phone. For example, for the phone "/k/" in the word "cat," the preceding context 212, current context, 214, and following context 216 may correspond to "/ux/", "/k/", and "/a", respectively.

Phones may also be segmented into states. For example, phones may be segmented into three states, where the first state corresponds to the first temporal portion of the phone, the second state corresponds to the second temporal portion of the phone, and the third state corresponds to the third temporal portion of the phone. The state number 218 may represent a state for the output of the neural network 200. For example, where the phones are segmented into four states, the state numbers may go from zero to three to correspond to respective states of the phone, and inputting a state of three may result in the neural network 200 outputting target acoustic features for the last temporal quarter of the phone.

The hidden layers 220, 230 may process the inputs from the input layer 210. The hidden layers 220, 230 may each include one or more nodes that may be interconnected to nodes of other layers based on training the neural network 200 using known inputs and desired outputs for the known inputs.

Output layer 240 may output target acoustic features 242 and standard deviations 244 based on the processing performed by the one or more hidden layers 220, 230 on the inputs. The target acoustic features 242 may be a vector of forty elements that have values that represent means and standard deviations 244 for those values.

Figure 3:
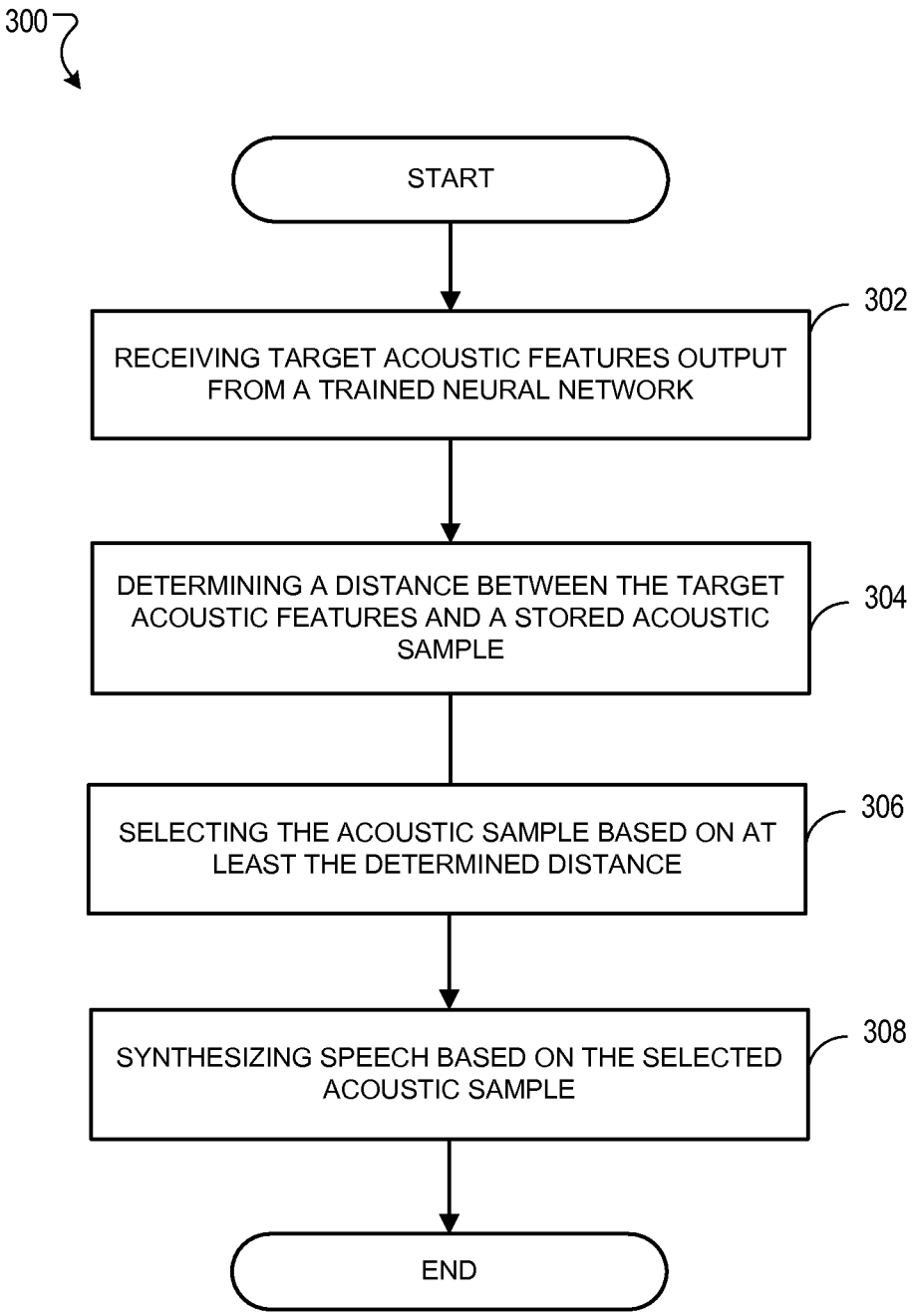
FIG. 3 is a flowchart of an example process for synthesizing speech.

FIG. 3 is a flowchart of an example process 300 for synthesizing speech. The following describes the processing 300 as being performed by components of the system 100 that are described with reference to FIG. 1. However, the process 300 may be performed by other systems or system configurations.

The process 300 may include receiving target acoustic features output from a trained neural network (302). For example, the acoustic sample selector 140 may receive target acoustic features output from the neural network 130 in response to linguistic features 120 received by the neural network 130.

The process 300 may include determining a distance between the target acoustic features and a stored acoustic sample (304). For example, the acoustic sample selector 140 may access a particular stored acoustic sample and the distance calculator 150 may calculate the distance between acoustic features of the particular acoustic sample and the target acoustic features.

The process 300 may include selecting the acoustic sample based on at least the determined distance (306). For example, the acoustic sample selector 140 may generate a list of candidate acoustic samples that includes the particular acoustic sample based on the distance for the particular acoustic sample calculated by the distance calculator 150. The acoustic sample selector 140 may then select the particular acoustic sample based on determining that selecting the particular acoustic sample results reduces a cost function based on the sample cost, e.g., distance, and a join cost to other selected acoustic samples. For example, the acoustic sample selector 140 may select the particular acoustic sample based on determining that selecting the particular acoustic sample results in minimizing a cost function based on the sample cost.

The process 300 may include synthesizing speech based on the selected acoustic sample (308). For example, the speech synthesizer 170 may receive the acoustic samples selected by the acoustic sample selector 140 and concatenate the selected samples together to generate synthesized speech 180.

In the above examples, the acoustic sample selector 140 may select acoustic samples on an individual sample basis. However, the acoustic sample selector 140 may also select acoustic samples on a sample-state basis or a model basis. Selecting acoustic samples on a sample-state basis may be more computationally intensive but may result in greater accuracy in the speech synthesized. Selecting acoustic samples on a model basis may be less computationally intensive, but may result in less accuracy in the speech generated.

Figure 4:
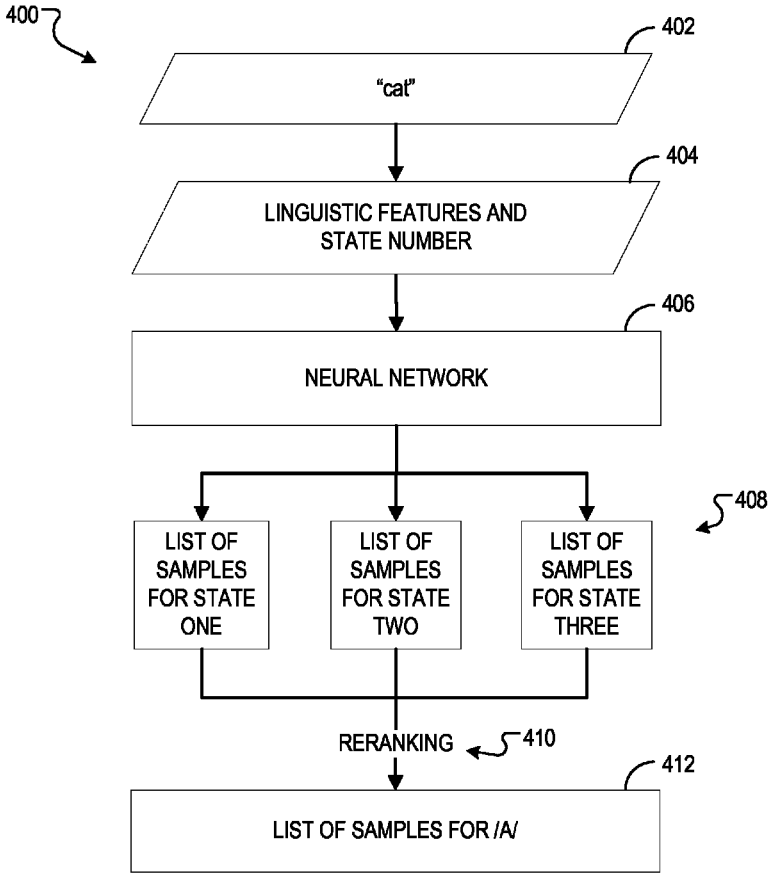
FIG. 4 is a flowchart of an example process for state based speech synthesis.

FIG. 4 is a flowchart of an example process 400 for state based speech synthesis. The following describes the process 400 as being performed by components of the system 100 that are described with reference to FIG. 1. However, the process 400 may be performed by other systems or system configurations.

The process 400 may determine candidate acoustic samples for three states of the phone "/a/" for the text "cat." The system 100 may first receive the text "cat" (402) and determine linguistic features from the text (404). For example, the system 100 may determine the linguistic features "/a/+/t/−/k/," and determine state numbers zero through two each corresponding to a different state of the three states.

The process 400 may continue with inputting the linguistic features into the neural network 130 along with a state number (406). The process may input the linguistic features into the neural network 130 along with different state numbers. For example, when using three states, the system 100 may first input the linguistic features using state number zero, then input the linguistic features using the state number one, and then input the linguistic features using state number two.

The neural network 130 may output sets of target acoustic features from the linguistic features and the acoustic sample selector 140 may generate lists of candidate acoustic samples for each state (408). Each set of target acoustic features may correspond to a different state number. For example, when there are three states, the neural network 130 may output three sets of target acoustic features for each set of linguistic features.

The acoustic sample selector 140 may generate the list of candidate acoustic samples for each state based on the sets of target acoustic features. The acoustic sample selector 140 may generate the list of acoustic samples so that the acoustic features of the acoustic samples are below a maximum threshold distance from the target acoustic features. For example, the acoustic sample selector 140 may determine all acoustic samples with acoustic features that have a Euclidean distance of less than twenty from the target acoustic features.

Once the lists of candidate acoustic samples are generated, the acoustic sample selector 140 may re-rank the candidate acoustic samples to generate an aggregate list of candidate acoustic samples (410). The acoustic sample selector 140 may re-rank the candidate acoustic samples by determining an aggregate distance for each candidate acoustic sample.

The acoustic sample selector 140 may determine an aggregate distance for a particular candidate acoustic sample by adding the distances for a particular candidate acoustic sample across the lists (412). For example, if a particular acoustic sample has a distance of two in the first list, four in the second list, and three in the third list, the particular acoustic sample may have an aggregate distance of seven.

Alternatively, the acoustic sample selector 140 may determine an aggregate distance based on a weighted sum of the distances for the state, where the states can have different associated weights. For example, the second state may have a slightly higher weight than the first and third state so that the beginning portion and ending portion of the candidate acoustic sample are less important to match than the middle portion of the candidate acoustic sample.

If a particular candidate acoustic sample is not in one or more of the lists for the states, the particular candidate acoustic sample may be excluded from the aggregate list. The acoustic sample selector 140 may then use the aggregate distance as a sample cost and select the acoustic samples to be used in speech synthesis based on reducing the sample cost and join costs. For example, the acoustic sample selector 140 may use the aggregate distance as a sample cost and select the acoustic samples to be used in speech synthesis based on minimizing the sample cost and join costs.

In some implementations, the acoustic sample selector 140 may select acoustic samples based on models that include multiple acoustic samples. The neural network 130 may be trained to output target acoustic features that describe a target model. The acoustic sample selector 140 may then determine models that are close to the target model by using the distance calculator 150. Acoustic samples within a particular model may all be associated with the same calculated distance between the target model and the model. The acoustic sample selector 140 may then use the calculated distances as sample costs and select acoustic samples that reduce a cost function based on sample costs and join costs of the acoustic samples. For example, the acoustic sample selector 140 may use the calculated distances as sample costs and select acoustic samples that minimize a cost function based on sample costs and join costs of the acoustic samples.

Alternatively, the sample cost for a particular acoustic sample in a particular model may be based on (i) the calculated distance between the target model and the particular model and (ii) the Mahalanobis distance of the particular acoustic sample in the particular model. For example, the target cost of a particular acoustic sample may be the summation of (i) the product of a normalizing constant and the distance between the target model and the particular model and (ii) the product of another normalizing constant and the Mahalanobis distance of the particular acoustic sample in the particular model. The Mahalanobis distance for acoustic samples in models may be pre-computed before the text to synthesize is received.

The models may be associated with phones. For example, a model that is known to include acoustic samples for the phones "/k/" and "/a/" may be indexed as being associated with the phones "/k/" and "/a/." The acoustic sample selector 140 may then also determine models that are close to the target model by initially filtering the models to exclude all models that are not indexed as including a phone in the linguistic features, and then determining close models by using the distance calculator 150.

Embodiments of the subject matter, the functional operations and the processes described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible nonvolatile program carrier for execution by, or to control the operation of, data processing apparatus. Alternatively or in addition, the program instructions can be encoded on an artificially generated propagated signal, e.g., a machine-generated electrical, optical, or electromagnetic signal that is generated to encode information for transmission to suitable receiver apparatus for execution by a data processing apparatus. The computer storage medium can be a machine-readable storage device, a machine-readable storage substrate, a random or serial access memory device, or a combination of one or more of them.

The term "data processing apparatus" encompasses all kinds of apparatus, devices, and machines for processing data, including by way of example a programmable processor, a computer, or multiple processors or computers. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, or a combination of one or more of them.

A computer program (which may also be referred to or described as a program, software, a software application, a module, a software module, a script, or code) can be written in any form of programming language, including compiled or interpreted languages, or declarative or procedural languages, and it can be deployed in any form, including as a standalone program or as a module, component, subroutine, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Computers suitable for the execution of a computer program include, by way of example, can be based on general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Computer readable media suitable for storing computer program instructions and data include all forms of nonvolatile memory, media and memory devices, including by way of example semiconductor memory devices, e.g., EPROM, EEPROM, and flash memory devices; magnetic disks, e.g., internal hard disks or removable disks; magneto optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous. Other steps may be provided, or steps may be eliminated, from the described processes. Accordingly, other implementations are within the scope of the following claims.

The invention claimed is:

1. A method comprising:

obtaining a set of phones that is associated with text that is to be synthesized into speech;

accessing a neural network that has been trained to estimate a set of target acoustic features that represent a close acoustic match to a given set of phones;

providing a particular set of phones for input to the neural network;

receiving, from the neural network, a particular set of target acoustic features that represents the acoustic match to the particular set of phones;

determining a distance between (i) the particular set of target acoustic features that the neural network indicates represents the acoustic match to the particular set of phones and (ii) a set of acoustic features that is associated with a stored acoustic sample;

selecting the acoustic sample to be used in synthesizing the text into speech based at least on the determined distance between (i) the particular set of target acoustic features that the neural network indicates represents the acoustic match to the particular set of phones and (ii) the set of acoustic features that is associated with the stored acoustic sample;

synthesizing, using an automated speech synthesizer, the text into speech using the selected acoustic sample; and providing the speech for output.

2. The method of claim 1, wherein the particular set of target acoustic features that the neural network indicates represents the acoustic match to the particular set of phones comprise a plurality of values describing acoustic characteristics.

3. The method of claim 2, wherein determining a distance between (i) the particular set of target acoustic features that the neural network indicates represents the acoustic match to the particular set of phones and (ii) a set of acoustic features that is associated with a stored acoustic sample comprises:

calculating an Euclidean distance between a point represented by the values of the set of target acoustic features that the neural network indicates represents the acoustic match to the particular set of phones and a point represented by values describing the set of acoustic features that is associated with the stored acoustic sample.

4. The method of claim 1, wherein selecting the acoustic sample to be used in synthesizing the text into speech based on at least the determined distance between (i) the particular set of target acoustic features that the neural network indicates represents the acoustic match to the particular set of phones and (ii) the set of acoustic features that is associated with the stored acoustic sample comprises:

determining the acoustic sample corresponds to a cost based on the determined distance that is less than or equal to costs based on other determined distances between the particular set of target acoustic features and sets of acoustic features of other stored acoustic samples.

5. The method of claim 1, wherein selecting the acoustic sample to be used in synthesizing the text into speech is further based on at least a join cost of the acoustic sample representing discontinuity of the acoustic sample and another acoustic sample consecutive with the acoustic sample.

6. The method of claim 5, wherein selecting the acoustic sample to be used in synthesizing the text into speech based on at least the determined distance between (i) the particular set of target acoustic features that the neural network indicates represents the acoustic match to the particular set of phones and (ii) the set of acoustic features that is associated with the stored acoustic sample comprises:

determining the acoustic sample corresponds to a cost, based on (i) the determined distance and (ii) the join cost, that is less than or equal to costs based on (i) determined distances between the target acoustic features and acoustic features of other stored acoustic samples and (ii) join costs of the other stored acoustic samples.

7. The method of claim 1, further comprising:

determining a distance between the particular set of target acoustic features and a model that includes the stored acoustic samples and other acoustic samples; and selecting, based on at least the determined distance, the model to select acoustic samples within the model.

8. A system comprising:

one or more computers and one or more storage devices storing instructions that are operable, when executed by the one or more computers, to cause the one or more computers to perform operations comprising:

obtaining a set of phones that is associated with text that is to be synthesized into speech;

accessing a neural network that has been trained to estimate a set of target acoustic features that represent a close acoustic match to a given set of phones;

providing a particular set of phones for input to the neural network;

receiving, from the neural network, a particular set of target acoustic features that represents the acoustic match to the particular set of phones;

determining a distance between (i) the particular set of target acoustic features that the neural network indicates represents the acoustic match to the particular set of phones and (ii) a set of acoustic features that is associated with a stored acoustic sample;

selecting the acoustic sample to be used in synthesizing the text into speech based at least on the determined distance between (i) the particular set of target acoustic features that the neural network indicates represents the acoustic match to the particular set of phones and (ii) the set of acoustic features that is associated with the stored acoustic sample;

synthesizing, using an automated speech synthesizer, the text into speech using the selected acoustic sample; and providing the speech for output.

9. The system of claim 8, wherein the particular set of target acoustic features that the neural network indicates represents the acoustic match to the particular set of phones comprise a plurality of values describing acoustic characteristics.

10. The system of claim 9, wherein determining a distance between (i) the particular set of target acoustic features that the neural network indicates represents the acoustic match to the particular set of phones and (ii) a set of acoustic features that is associated with a stored acoustic sample comprises:

calculating an Euclidean distance between a point represented by the values of the set of target acoustic features that the neural network indicates represents the acoustic match to the particular set of phones and a point represented by values describing the set of acoustic features that is associated with the stored acoustic sample.

11. The system of claim 8, wherein selecting the acoustic sample to be used in synthesizing the text into speech based on at least the determined distance between (i) the particular set of target acoustic features that the neural network indicates represents the acoustic match to the particular set of phones and (ii) the set of acoustic features that is associated with the stored acoustic sample comprises:

determining the acoustic sample corresponds to a cost based on the determined distance that is less than or equal to costs based on other determined distances between the particular set of target acoustic features and sets of acoustic features of other stored acoustic samples.

12. The system of claim 8, wherein selecting the acoustic sample to be used in synthesizing the text into speech is further based on at least a join cost of the acoustic sample representing discontinuity of the acoustic sample and another acoustic sample consecutive with the acoustic sample.

13. A non-transitory computer-readable medium storing software comprising instructions executable by one or more computers which, upon such execution, cause the one or more computers to perform operations comprising:

obtaining a set of phones that is associated with text that is to be synthesized into speech;

accessing a neural network that has been trained to estimate a set of target acoustic features that represent a close acoustic match to a given set of phones;

providing a particular set of phones for input to the neural network;

receiving, from the neural network, a particular set of target acoustic features that represents the acoustic match to the particular set of phones;

determining a distance between (i) the particular set of target acoustic features that the neural network indicates represents the acoustic match to the particular set of phones and (ii) a set of acoustic features that is associated with a stored acoustic sample;

selecting the acoustic sample to be used in synthesizing the text into speech based at least on the determined distance between (i) the particular set of target acoustic features that the neural network indicates represents the acoustic match to the particular set of phones and (ii) the set of acoustic features that is associated with the stored acoustic sample;

synthesizing, using an automated speech synthesizer, the text into speech using the selected acoustic sample; and providing the speech for output.

14. The medium of claim 13, wherein the particular set of target acoustic features that the neural network indicates represents the acoustic match to the particular set of phones comprise a plurality of values describing acoustic characteristics.

15. The medium of claim 14, wherein determining a distance between (i) the particular set of target acoustic features that the neural network indicates represents the acoustic match to the particular set of phones and (ii) a set of acoustic features that is associated with a stored acoustic sample comprises:

calculating an Euclidean distance between a point represented by the values of the set of target acoustic features that the neural network indicates represents the acoustic match to the particular set of phones and a point represented by values describing the set of acoustic features that is associated with the stored acoustic sample.

16. The medium of claim 13, wherein selecting the acoustic sample to be used in synthesizing the text into speech based on at least the determined distance between (i) the particular set of target acoustic features that the neural network indicates represents the acoustic match to the particular set of phones and (ii) the set of acoustic features that is associated with the stored acoustic sample comprises:

determining the acoustic sample corresponds to a cost based on the determined distance that is less than or equal to costs based on other determined distances between the particular set of target acoustic features and sets of acoustic features of other stored acoustic samples.

17. The medium of claim 13, wherein selecting the acoustic sample to be used in synthesizing the text into speech is further based on at least a join cost of the acoustic sample representing discontinuity of the acoustic sample and another acoustic sample consecutive with the acoustic sample.

* * * * *